US005256319A

United States Patent [19]

Parc et al.

[11] Patent Number: 5,256,319

[45] Date of Patent: Oct. 26, 1993

[54] NEW THIOPHOSPHORETTED COMPOUNDS, THEIR PREPARATION AND THEIR USE AS ADDITIVES FOR LUBRICANTS

[75] Inventors: Guy Parc, Rueil-Malmaison; Nicole Thevenin, Paris; Maurice Born, Nanterre; Jacques Lallement, Aubervilliers, all of France

[73] Assignee: Institut Francais Du Petrole, Rueil Malmaison, France

[21] Appl. No.: 781,609

[22] Filed: Oct. 23, 1991

Related U.S. Application Data

[62] Division of Ser. No. 500,827, Mar. 29, 1990, Pat. No. 5,080,812.

[30] Foreign Application Priority Data

Mar. 30, 1989 [FR] France ..... 89 04345

[51] Int. Cl.[5] ..... C10M 137/10; C10M 139/00

[52] U.S. Cl. ..... 252/32.7 R; 252/42.7; 252/46.3; 252/46.6; 252/46.7

[58] Field of Search ..... 252/18, 32.7 RE, 42.7, 252/46.6, 46.7, 46.3

[56] References Cited

U.S. PATENT DOCUMENTS

| | | | |
|---|---|---|---|
| 2,373,811 | 4/1945 | Cook et al. | 252/46.6 |
| 2,451,345 | 10/1948 | McNab et al. | 252/32.7 |
| 2,534,217 | 12/1950 | Bartleson | 252/46.6 |
| 2,698,296 | 12/1954 | Musselman et al. | 252/32.7 |
| 2,905,639 | 9/1959 | Krzikalla et al. | 252/46.7 |
| 2,956,018 | 10/1960 | Carlyle et al. | 252/32.7 |
| 3,057,896 | 10/1962 | Schlicht et al. | 252/18 |
| 3,135,692 | 6/1964 | Kjonaas | 252/46.6 |
| 3,214,423 | 10/1965 | Zech et al. | 252/46.6 |
| 3,337,456 | 8/1967 | Papayannopoulos | 252/32.7 R |
| 3,489,682 | 1/1970 | LeSuer | 252/32.7 |
| 3,492,231 | 1/1970 | McMillen | 252/33 |
| 3,549,534 | 12/1970 | Holstedt | 252/42.7 |
| 3,980,573 | 9/1976 | Okorodudu | 252/46.7 |
| 4,188,299 | 2/1980 | Caspari | 252/46.4 |
| 4,328,111 | 5/1982 | Watson et al. | 252/33.4 |
| 4,897,209 | 1/1990 | Law | 252/46.6 |
| 5,080,812 | 1/1992 | Parc et al. | 252/327 R |

FOREIGN PATENT DOCUMENTS 0590885 7/1947 United Kingdom .

*Primary Examiner*—Margaret Medley

*Attorney, Agent, or Firm*—Millen, White, Zelano, & Branigan

[57] ABSTRACT

A composition of a thiophosphoretted additive obtained by reacting a sodium or a calcium sulfonate surbasified by sodium or calcium carbonate, showing 0.9 to 10 basic equivalents per kilogram, with a phosphorus sulfide used in such proportion that he ratio of molar phosphorus to the basic equivalent of the surbasified sulfonate ranges from 0.002 to 0.15; and contacting resultant reaction product of the surbasified sulfonate and the phosphorus sulfide with at least one active hydrogen compound which is water, an alcohol, a phenol, a carboxylic acid, an ester-acid, a mineral acid, a mineral base, an amine, an amide or a mercaptan.

19 Claims, No Drawings

NEW THIOPHOSPHORETTED COMPOUNDS, THEIR PREPARATION AND THEIR USE AS ADDITIVES FOR LUBRICANTS

This is a division of application Ser. No. 07/500,827 filed Mar. 29, 1990, now U.S. Pat. No. 5,080,812, issued Jan. 14, 1992.

BACKGROUND OF THE INVENTION

The present invention relates to new thiophosphoretted compounds soluble in the mineral oils obtained by reacting at least one phosphorus sulfide with at least one detergent sulfonate known as "surbasic".

In a general way, a surbasic detergent sulfonate can be defined as composed of a surface-active agent essentially consisting of an alkaline or alkaline-earth salt of a sulfonic acid comprising oleophilic groups and keeping in colloidal dispersion salts of mineral weak acids such as $CO_2$, $H_2S$ and alkaline or alkaline-earth bases.

According to the invention, the product of the reaction between the phosphorus sulfide and the surbasic detergent sulfonate can be optionally treated by at least one active hydrogen compound which may be water, an alcohol, a phenol, a carboxylic acid, an ester-acid, a mineral acid, a mineral base, an amine, an amide or a mercaptan.

The present invention also relates to the preparation of these new thiophosphoretted compounds and to their use as additives in mineral and synthetic lubricants. In particular, it has been discovered that these new additives show antiwear and extreme-pressure properties which are very interesting for use with motor oils, gear oils, hydraulic fluids, lubricating greases or metal-working oils.

Antiwear and extreme-pressure additives are added to lubricants when intended for lubricating parts subjected to heavy mechanical stresses, such as the distribution in thermal engines, gears, bearings or thrusts. Heavy mechanical stresses also appear during the machining of metals, be it cutting or forming.

The antiwear additives which are most widely used in engines are the zinc dialkyldithiophosphates, but the efficiency of these additives is reduced by the presence of nitrogenated dispersers, probably because of the forming of coordination complexes between these two types of additives. Modern motor oils require large amounts of dispersers to be in accordance with the VE test of the SG specification of the American Petroleum Institute. The higher additive content which is necessary to keep the antiwear qualities constant leads to an increase in the phosphorus content in the motor oils, whereas it is precisely the contrary which is sought after for maximum efficiency of the catalytic mufflers intended for reducing the pollution caused by the exhaust gases.

As for transmission oils, two types of additives are widely used: the phosphosulfurized additives and the additives based on potassium borate dispersion. The main drawback of mineral oils containing phosphosulfurized additives is their thermal instability, which begins to show as low as 120°-130° C. As a matter of fact, it is not unusual to reach temperatures of 150° C. in the transmissions of heavy-duty vehicles or of private cars used in severe conditions. Transmission oils based on potassium borate clearly show a greater thermal stability, but they are water-susceptible, which may represent an obstacle for certain uses. More efficient antiwear and extreme-pressure additives with a higher thermal stability and showing less interactions with the other additives in the formulations are actively searched for.

SUMMARY OF THE INVENTION

The micellar thiophosphoretted compounds of the present invention can be defined in a general way as being obtained by reacting at least one surbased sulfonate (A) with a phosphorus sulfide (B), and the reaction product is contacted with at least one active hydrogen compound (C). The reaction between A and B, and possibly the subsequent treatment by C, can be advantageously carried out in a solvent (D).

Compound A is a surbasic sulfonate obtained from at least one salt of an alkaline or alkaline-earth metal of at least one acid compound selected from the sulfonic acids, natural or synthetic. The surbasification of the salts of alkaline or alkaline-earth metals of these acids is generally performed in the presence of a promoter, by treating an excess oxide or hydroxide of an alkaline or alkaline-earth metal suspended in the reaction medium, by a weak acid such as $CO_2$, $SO_2$, $H_2S$ or $H_3BO_3$. The cations which are most often used for the surbasification are sodium, magnesium, calcium and barium utilized in their oxide or hydroxide form. The promoter is an alcohol, particularly methanol, an alkylphenol or an amine compound such as liquid ammonia, an amine or an amino alcohol. The weak acid which is preferably used is $CO_2$.

The preparation of surbasic additives is well-known and described for example in U.S. Pat. Nos. 2,865,956; 3,150,088; 3,537,996; 3,830,739; 3,865,737; 4,148,740 and 4,505,830 and in French Patent No. 2,101,813. There are variants of the surbasification reaction which especially resort to carbonates that are performed from alcoxydes and $CO_2$ before contacting the alkaline or alkaline-earth salt of the acid compound; they are especially described in U.S. Pat. Nos. 2,956,018; 3,932,289 and 4,104,180.

The sulfonic acids used for manufacturing surbasic sulfonates usable according to the invention are known and described in numerous patents, for example in French Patent No. 2,101,813, pages 5 and 6. The hydrocarbon part of the molecule advantageously has a molecular weight that is at least equal to 370 in order to ensure the miscibility of the corresponding sulfonates in the mineral oils. The sulfonic acids can be those known as "natural", stemming from the sulfonation of petroleum cuts, or synthetic acids prepared by sulfonation of charges prepared through a synthetic process: alkenylic hydrocarbons, such as polyisobutenes ((U.S. Pat. No. 4,159,956), alkylarylic hydrocarbons as for example the postdodecylbenzenes obtained as tailings in the manufacturing of dodecylbenzene.

DETAILED DESCRIPTION OF THE INVENTION

The preferred surbasic compounds A according to the invention are sodium or calcium sulfonates that are surbased by sodium or calcium carbonate.

The surbasic sulfonates A which are usable according to the invention show an alkalinity expressed in terms of TBN (equivalent alkalinity expressed in milligram of KOH per g of product) ranging from 50 to 550 (that is to say from 0.9 to 10 basic equivalents per kg) and preferably from 150 to 450 (that is to say 2.7 to 8 basic equivalents per kg).

Compound B is a phosphorus sulfide such as $P_4S_7$, $P_4S_9$, $P_4S_{10}$. $P_4S_{10}$ is the preferred phosphorus sulfide according to the invention. The phosphorus sulfide is utilized in such an amount that he ratio molar P/EB, where EB represents the basic equivalent of the surbasic additive, ranges from 0.002 to 0.15 and preferably from 0.02 to 0.12. Beyond the ratio molar P/EB=0.15, the reaction between the surbasic additive and the phosphorus sulfide might be incomplete.

The compound C that can be optionally utilized is a compound comprising active hydrogen; it can be water, an alcohol such as methanol or isopropanol, a phenol, an acid such as a carboxylic acid like acetic acid, an acid ester such as a dialkylphosphite, a mineral acid such as boric acid or phosphoric acid, a base such as ammonia or an amine, an amide, a mercaptan, such as dimercaptothiadiazole or its substituted derivatives of formula

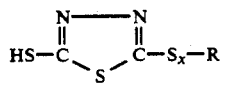

wherein X is 1-5; when X is 1, R is H or hydrocarbyl, and when X is above 1, R is hydrocarbyl.

The molar amount of compound C that is introduced in relation to the molar amount of phosphorus supplied by the phosphorus sulfide may vary in a ratio ranging from 0.1 to 5 and preferably from 0.3 to 3.

The compounds C that are preferred according to the invention are ammonia, isopropanol, the dialkylphosphites, boric acid, the mercaptans, particularly the dimercaptothiadiazole derivatives.

The solvent D which can be optionally used allows the viscosity of the reaction medium to be reduced, resulting in improved contact between the reagents. As examples of the solvents which can be used according to the invention, cyclohexane, toluene, the xylenes and, in a general way, hydrocarbon cuts with a boiling range from 60° to 150° C. and preferably from 90° to 120° C. can be cited.

The additives obtained according to the invention may show a certain reactivity in relation to copper alloys. The use of sequestering additives of the dimercaptothiadiazole type in doses ranging from 0.25 to 0.75% by weight in the final formulations leads to a totally satisfactory behavior in relation to copper. The required dose is lower when compound C itself is a mercaptothiadiazole derivative. It may for example reach 0.5% by weight.

The nature of the compounds formed during the reaction is not known with certainty. It can be assumed that the phosphorus sulfides react on the colloidal dispersion of the salt of a weak acid and of the alkaline or alkaline-earth base, in order to form alkaline or alkaline-earth mineral thiophosphates. This hypothesis is reinforced by the fact that, during the dialysis in the hydrocarbon medium of the products according to the invention, the total phosphorus is recovered in the non-dialysed fraction.

Another characteristic of the present invention is that, in the defined limits, the products obtained remain in the colloidal state while forming solutions in hydrocarbons which are perfectly limpid and stable over time.

The process for manufacturing the compounds according to the invention comprises the following stages:

Stage 1: The reaction of the phosphorus sulfide on the surbasic sulfonate can be carried out at a pressure ranging from the atmospheric pressure to about 5 absolute bars (0.5 MPa), at a temperature ranging from 60° to 130° C. and preferably from 85° to 120° C. The reaction between the phosphorus sulfide, the solid reagent and the surbasic additive is made easier by properly stirring the reaction medium and optionally by the use of a hydrocarbon solvent D. The phosphorus sulfide can e progressively introduced into the reaction medium, but it can also be introduced in its entirety at the beginning of the manipulation into the surbasic compound possibly dissolved in a hydrocarbon solvent, provided that the temperature of the reaction medium is lower than about 60° C. The reaction is then started by progressively increasing the temperature within the limits given above.

Stage 2: The active hydrogen compound C can be used in the gaseous, liquid or solid form, and the means for introducing it into the reaction medium will be adapted to its physical state. The reaction can be carried out at a pressure ranging from the atmospheric pressure to about 5 absolute bars (0.5 MPa), at a temperature ranging from 60° to 130° C. and preferably from 25° to 120° C.

Stage 3: Filtering and removal of the solvents and of the possible excess reagent. The filtering stage is not always necessary, since stages 1 and 2 most often lead to homogeneous liquid mixtures. When filtering is imperative, it can be performed before removing solvent D, for example on simple cellulose disks, or on layers of filtering agents of the diatomite type or of natural silica of volcanic origin. Filtering can also be carried out after removing the solvents. In that case, it is advantageous to carry out a hot filtration, for example at a temperature ranging from 90° to 120° C. and under a pressure from 2 to 5 bars.

The distillation of the solvent can be achieved in the reaction itself. Removing the last traces can be facilitated by a nitrogen striping process. It can also be carried out in a thin-film evaporator.

The following examples illustrate the invention. On no account should they be considered as limiting the scope thereof.

EXAMPLE 1

292.8 g of a calcium sulfonate surbased by calcium carbonate the TBN of which is 410 mg KOH/g (that is to say an amount of basic equivalents of 7.32 per kg) and 300 ml of toluene are introduced into a stirred reactor and under blanketing nitrogen. When the mixture is homogeneous, 25.7 g (0.058 mole) of $P_4S_{10}$ are introduced into the reactor and the temperature is progressively brought up to 90° C., and then maintained at this level for 2 hours. The gaseous effluents are absorbed in a 10% potash solution. The reaction mixture is then flowed back; the temperature stabilizes at 115° C. After 2 hours at this temperature, the toluene is distilled in a nitrogen stream, then the reaction product is maintained at 155° C. for 2 hours while the nitrogen bubbling is continued. The product is finally filtered on filtering clay at 100° C., under a 3 bar-pressure of nitrogen. 301 g of a product showing the following elemental analysis is finally obtained:

| | |
|---|---|
| Ca | 14.7% by weight |
| P | 2.00% by weight |
| S | 4.2% by weight. |

EXAMPLE 2

The process is carried out as in example 1 until the end of the 2 hour-refluxing at 115° C. At that point, 12 g of ammonia (0.706 mole) are bubbled in the reaction mixture. The introduction duration is 1.5 hours. A nitrogen stream is then let through in order to drive away the excess ammonia and the reaction mixture is filtered on filtering clay. The toluene is distilled from the reaction mixture by means of a rotating evaporator. 307.4 g of a product the analysis of which is the following is finally recovered:

| | |
|---|---|
| Ca | 14.5% by weight |
| P | 2.06% by weight |
| S | 4.25% by weight |
| N | 0.58% by weight. |

EXAMPLE 3

293.7 g of the surbasic sulfonate used in the previous examples are dissolved in 300 ml of toluene, in a stirred reactor and under blanketing nitrogen. 23 g (0.052 mole of $P_4S_{10}$ are then progressively introduced into the reactor at a temperature of 90° C. After the end of the introduction of $P_4S_{10}$, the reaction mixture is maintained at this temperature for 2 hours, then the mixture is flowed back at 115° C. for 1 hour to make sure that the reaction is completed. The temperature is then brought down to 65° C. and 29.7 g (0.495 mole) of isopropanol diluted in 50 ml of toluene are progressively introduced, then the reaction medium is maintained at 75° C. for 3 hours. After cooling down, the mixture is filtered on infusorial earth and the volatile compounds are removed by means of a rotating evaporator.

313.2 g of a product the analysis of which is the following are finally obtained:

| | |
|---|---|
| Ca | 14.2% by weight |
| P | 1.87% by weight |
| S | 3.25% by weight. |

EXAMPLE 4

The process is carried out as in example 3, except that 5 g (0.278 mole) of water are progressively introduced instead of the isopropanol diluted in toluene. 294.1 g of a product with the following composition are finally recovered:

| | |
|---|---|
| Ca | 14.4% by weight |
| P | 1.84% by weight |
| S | 2.85% by weight. |

EXAMPLE 5

The reaction is carried out under the same conditions as in example 3, except that the alcohol that is used is methanol. The amount of methanol introduced in the same conditions as above is 16 g (0.5 mole). After filtration, and then removing the volatile compounds, 310.7 g of a product the analysis of which follows are finally recovered:

| | |
|---|---|
| Ca | 14.4% by weight |

-continued

| | |
|---|---|
| P | 1.99% by weight |
| S | 3.8% by weight. |

EXAMPLE 6

244.75 g of the surbasic sulfonate used in the previous examples and 250 ml of toluene are introduced into a stirred reactor and under blanketing nitrogen. The mixture is brought up to 85°-90° C. 18.7 g (0.042 mole) of $P_4S_{10}$ are then introduced within 1 hour, the gaseous effluents are collected in a 10% potash solution. The mixture is maintained under stirring at 90° C. for 3 more hours. The total $P_4S_{10}$ has then begun to react. 10.2 g of a dimercaptothiadiazole derivative, marketed by the AMOCO company under the commercial denomination AMOCO 153, dissolved in an equivalent mass of toluene, is ten introduced. The temperature is brought up to 115° C. and maintained for 1.5 hour. The toluene is then distilled in a nitrogen stream. 263.1 g of a viscous liquid the calcium, phosphorus, sulfur and nitrogen concentrations of which are the following are then recovered:

| | |
|---|---|
| Ca | 14.3% by weight |
| P | 1.71% by weight |
| S | 5.3% by weight |
| N | 0.31% by weight. |

EXAMPLE 7

The process is carried out as in example 1, but with the following reagent amounts:

surbasic sulfonate used in the previous examples = 247.7 g $P_4S_{10}$ = 8.25 (0.019 mole)

toluene = 250 ml.

The product obtained after filtering and removal of the toluene, that is 253.3 g, shows the following characteristics:

| | |
|---|---|
| Ca | 14.2% by weight |
| P | 0.88% by weight |
| S | 2.25% by weight. |

EXAMPLE 8

The process is carried out as in example 5 up to the complete reaction of $P_4S_{10}$. 24.5 g of boric acid are then introduced into within one hour. The mixture is then flowed back at 115° C. for 1.5 hour. After filtering on a cellulose filter and evaporation of the solvent, 266.3 g of a product the analysis of which is the following are obtained:

| | |
|---|---|
| Ca | 14.0% by weight |
| P | 1.69% by weight |
| S | 4.2% by weight |
| B | 1.51% by weight. |

EXAMPLE 9

The process is carried out as in example 6 up to the complete reaction of $P_4S_{10}$. The temperature being maintained at 90° C., 49.5 g of didodecylphosphite dissolved in 50 ml of toluene are introduced within 1 hour. The temperature is then brought to 115° C. and maintained for 3 hours.

The toluene is then distilled in a nitrogen stream. 302 g of a viscous liquid the analysis of which is the following are finally recovered:

| | |
|---|---|
| Ca | 12.2% by weight |
| P | 2.78% by weight |
| S | 3.45% by weight. |

EXAMPLE 10

The reaction is carried out with the same amounts of reagents and in the same conditions as in example 3, except hat the reaction is performed in a Hastelloy (registered trademark) pressure reactor equipped with an absolutely tight magnetic stirring system. After cooling down, the reactor is brought back to atmospheric pressure and the filtration and the removing of the volatile compounds are performed. After these operations, 315.1 g of a product with the following composition are recovered:

| | |
|---|---|
| Ca | 14.1% by weight |
| P | 1.95% by weight |
| S | 4.5% by weight. |

EXAMPLE 11

The reaction is carried out under the same conditions as in example 1, except that the compound A used is 324.5 g of a sodium sulfonate surbased by calcium carbonate with a TBN of 370 mg KOH/g (that is an amount of basic equivalents of 6.6/kg). 342.1 g of a product with the following composition are finally recovered:

| | |
|---|---|
| Ca | 11.3% by weight |
| Na | 1.30% by weight |
| P | 1.92% by weight |
| S | 3.70% by weight. |

EXAMPLE 12

The reaction is carried out with the same amounts of reagents and in the same condition as in example 3, except that after the 1 hour-refluxing at 115° C. and before the introduction of isopropanol, 6.4 g (0.043 mole) of 2,5-dimercapto-1,3,4-thiadiazole are progressively added to the reaction medium the temperature of which has been previously brought down to 90° C.

The addition of isopropanol and the end of the manufacturing are then performed according to the introductions of example 3. 323.4 g of a viscous liquid the analysis of which is the following are finally recovered:

| | |
|---|---|
| Ca | 14.0% by weight |
| P | 1.94% by weight |
| S | 4.62% by weight |
| N | 0.45% by weight. |

EXAMPLE 13

Evaluation of the Antiwear and Extreme-Pressure Properties

The products described in the previous examples have been evaluated as for their antiwear and extreme-pressure properties in a lubricating oil. The mineral base oil that is utilized is a Neutral 130 with the following characteristics:

| | |
|---|---|
| Kinematic viscosity at 40° C. | 25.5 $mm^2/s$ |
| Kinematic viscosity at 100° C. | 4.7 $mm^2/s$ |
| Viscosity index | 101 |
| Pour point | −15° C. |
| Sulfur content | 0.46% by wt. |

(a) FOUR BALL TEST

The antiwear efficiency is evaluated with a four-ball machine working during 1 hour under 40 and 60 daN loads at a speed of 1,500 rpm, according to the NF E48-617 method. The average impression diameters examined on the 3 lower balls are the following:

| Products | Impression diameter (mm) 40 daN | 60 daN |
|---|---|---|
| 130 N oil | 1.72 | 2.22 |
| Oil + 5.3% of the product from ex. 1 | 0.48 | 0.65 |
| Oil + 12% of the product from ex. 1 | 0.34 | 0.39 |
| Oil + 5.3% of the product from ex. 2 | 0.44 | 0.62 |
| Oil + 5.3% of the product from ex. 3 | 0.43 | 0.59 |
| Oil + 5.3% of the product from ex. 4 | 0.48 | 0.70 |
| Oil + 5.3% of the product from ex. 5 | 0.44 | 0.57 |
| Oil + 5.3% of the product from ex. 6 | 0.60 | 0.71 |
| Oil + 12% of the product from ex. 7 | 0.36 | 0.42 |
| Oil + 5.3% of the product from ex. 8 | 0.34 | 0.41 |
| Oil + 4.0% of the product from ex. 9 | 0.36 | 0.45 |
| Oil + 5.3% of the product from ex. 10 | 0.42 | 0.60 |
| Oil + 12% of the product from ex. 11 | 0.49 | 0.53 |

(b) FZG TEST

The extreme-pressure properties of the lubricating oils of the products according to the invention have been measured with an FZG gear machine according to the CDC L-07-A-71 method with the A/16.6/90 procedure, that is to say using the A type gear, with a peripheral velocity at the pitch diameter of 16.6 m/s and at a temperature of 90° C. at the beginning of each load level. The mineral oil that is used is the 130 N base described above. Visual evaluation method B has been utilized. The extreme-pressure efficiency is all the more pronounced since the load level that is reached is higher. When it was possible, the oil temperature at the end of level 12, that is in relation to the forces dissipated in friction, has also been recorded. A lower temperature shows a smaller coefficient of friction in the conditions of the test. The results obtained appear in the following table:

| Products | Damage level | t° at the end of level 12 (°C.) |
|---|---|---|
| 130 N oil | 4 | — |
| Oil + 5.3% of the product from ex. 1 | 13 | 142 |
| Oil + 12% of the product from ex. 1 | >13 | 134 |
| Oil + 5.3% of the product from ex. 2 | >13 | 145 |

-continued

| Products | Damage level | t° at the end of level 12 (°C.) |
|---|---|---|
| Oil + 5.3% of the product from ex. 3 | >13 | 143 |
| Oil + 5.3% of the product from ex. 5 | 10 | — |
| Oil + 5.3% of the product from ex. 6 | >13 | 145 |
| Oil + 12% of the product from ex. 7 | 13 | 158 |
| Oil + 6.5% of conventional phospho-sulfurized extreme-pressure additive | >13 | 162 |
| Oil + 12% of potassium triborate additive | >13 | 154 |
| Oil + 1.2% of zinc di(ethylhexyl)di-thiophosphate | 9 | — |

All these results show that the products according to the invention have very pronounced extreme-pressure properties and that the coefficient of friction is lower than that of the conventional extreme-pressure additives since the registered temperatures at the end of level 12 are clearly inferior, which obviously represents an advantage in severe conditions of use: gearboxes and rear axles of heavy-duty vehicles at low speed under high torque, railroad reducing gears of high-speed trains, reducing gears of helicopters, etc.

EXAMPLE 14

Thermal Engine Distribution Wear Test

In order to determine the behavior of additives according to the invention to the lubrication of engines, wear tests have been carried out with the cam-valve levers distribution model of a PEUGEOT XL5 engine. The camshaft is made of hardened cast iron, the valve levers are made of hardened 42C2 steel nitrided in a salt bath without cyanide (SURSULF process). The lubricating base is a 175 Neutral Solvent the main characteristics of which are the following:

| | |
|---|---|
| Kinematic viscosity at 40° C. | 33.7 $mm^2/s$ |
| Kinematic viscosity at 100° C. | 5.7 $mm^2/s$ |
| Viscosity index | 108 |
| Pour point | −9° C. |

The object of this test was to replace the antiwear additive and the detergent additive with an additive according to the invention. On the other hand, a conventional dispersant of the succinimide type which is usually utilized to meet the cold dispersivity requirements has been used.

The test bench is driven by an electric motor and works according to the following cycle:

| | |
|---|---|
| 1 minute at | 750 rpm |
| 2 minutes at | 1,500 rpm. |

The springs, under maximum lifting, are calibrated at 1,200 N. The test lasts 50 hours and the oil temperature is adjusted to 50° C. At the end of the test, the valve levers are weighed and measured according to a scale which defines four standard appearances.

Formulation I comprising an additive according to the invention has the following composition:

| | |
|---|---|
| product from example 6 = | 5.3% by weight |
| dispersant = | 5% by weight |

-continued

| | |
|---|---|
| 175 N base = | 89.7% by weight. |

By way of comparison, an oil II based on conventional additives has been tested in similar conditions. Its composition is the following:

| | |
|---|---|
| antiwear additives (zinc dialkyldithiophosphate) corresponding to 1,400 ppm of zinc = | 1.70% by wt |
| detergent additive = | 3.6% by wt |
| dispersant = | 5% by wt |
| 175 N base = | 89.7% by wt. |

The results obtained are shown hereunder:

| Formulation | Average wear per valve lever (mg) | Merit/100 |
|---|---|---|
| I | 27.8 | 41 |
| II | 36.4 | 25 |

It is show a lower wear and a better appearance of the valve levers with the formula utilizing the additive according to the invention.

EXAMPLE 15

Scoring Test on a Hypoid Gear Axle

The bench that is used and the testing conditions are described in detail in a paper given at the 7th international colloquium on automotive lubrication, Esslingen, Jan. 16–18, 1990 (The screening of E.P. oil formulas by the use of a new hypoid gear axle test; G. VENIZELOS, G. LASSAU, P. MARCHAND).

This test utilizes a PEUGEOT PC7 gear axle to which torque peaks of the order of 340 Nm are applied. The ring is examined without being dismantled every series of 20 torque peaks. In the absence of abnormal wear, the test is continued up to 80 torque peaks, after which the gear axle is dismantled and the pinion and ring surfaces are examined. The result is given in percentage of the carrying surface damaged by scoring.

The additives are compared in an identical a base oil (100 neutral solvent). A comparison test has bene carried out with an extreme-pressure oil marketed under the extreme-pressure additive which is widely used in hypoid gear axles.

| Product | Concentration (% by wt.) | Scoring (%) after 80 torque peaks |
|---|---|---|
| ANGLAMOL 99 | 6.5 | 2.25 |
| Product from example 12 | 12.9 * | 2.0 |

* 7.2% after deduction of the dilution oil.

What is claimed is:

1. A composition of a thiophosphoretted additive obtained by a process comprising reacting a sodium or a calcium sulfonate surbasified by sodium or calcium carbonate, showing 0.9 to 10 basic equivalents per kilogram, with a phosphorus sulfide used in such proportion that the ratio of molar phosphorus to the basic equivalent of the surbasified sulfonate ranges from 0.002 to 0.15 and;

contacting resultant reaction product of the surbasified sulfonate and the phosphorus sulfide with at least one active hydrogen compound selected from the group consisting of water, an alcohol, a phenol, a carboxylic acid, an ester-acid, a mineral acid, a mineral base, an amine, an amide and mercaptan.

2. A composition according to claim 1, wherein said alcohol is methanol or isopropanol, said carboxylic acid is acetic acid, said ester-acid is dialkylphosphite, said mineral acid is boric acid or phosphoric acid, said mineral base is ammonia, and said mercaptan in dimercaptothiadiazole or a substituted dimercaptothiadiazole of formula:

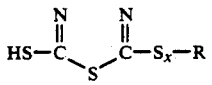

wherein x is 1–5; when x is 1; R is H or hydrocarbyl, and when x is above 1, R is hydrocarbyl.

3. A composition according to claim 2 wherein said phosphorus sulfide is selected from $P_4S_7$, $P_4$ $S_9$ and $P_4S_{10}$.

4. A composition according to claim 3 wherein said phosphorus sulfide is $P_4S_{10}$.

5. A composition according to claim 2 wherein the reaction is carried out at a pressure ranging from the atmospheric pressure to 0.5 MPa and at a temperature ranging from 60°–130° C.

6. A composition according to claim 5 wherein said phosphorus sulfide is $P_4S_{10}$.

7. A composition according to claim 1 wherein said active hydrogen compound is used in a molar amount from 0.1 to 5 per mole of phosphorus in the phosphorus sulfide.

8. A composition according to claim 1, wherein the contacting of said resultant reaction product with said active hydrogen compound is performed at a pressure ranging from the atmospheric pressure to 0.5 MPa and at a temperature ranging from 60 to 130° C.

9. A composition according to claim 1 prepared in a hydrocarbon solvent boiling between 60° and 150° C.

10. A composition according to claim 1, wherein said active hydrogen compound is a mercaptan, an amide or an amine.

11. A composition according to claim 1, wherein said active hydrogen compound is a mercaptan, an ester-acid, a mineral acid or a carboxylic acid.

12. A composition according to claim 1, wherein said active hydrogen compound is a mercaptan, water, an alcohol or a phenol.

13. A composition according to claim 1, wherein said active hydrogen compound is a mercaptan or ammonia.

14. A composition according to claim 1, wherein said active hydrogen compound is a mercaptan.

15. A composition according to claim 1, wherein said phosphorus sulfide is selected from $P_4S_7$, $P_4S_9$, and $P_4S_{10}$.

16. A composition according to claim 1, wherein said phosphorus sulfide is $P_4S_{10}$.

17. A composition according to claim 1, wherein said active hydrogen compound is dimercaptothiadiazole or a substituted dimercaptothiadiazole of the formula:

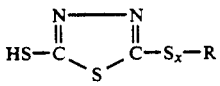

wherein X is 1–5, when X is 1, R is H or hydrocarbyl, and when X is above 1, R is hydrocarbyl.

18. A composition according to claim 17, wherein said active hydrogen compound is used in a molar amount of from 0.1 to 5 per mole of phosphorus in the phosphorus sulfide.

19. A mineral or synthetic oil, or a lubricating grease, comprising a composition according to claim 2 incorporated as an additive, at a concentration of 0.5 to 20% by weight.

* * * * *